US007036557B2

(12) United States Patent
Fest et al.

(10) Patent No.: US 7,036,557 B2
(45) Date of Patent: May 2, 2006

(54) DEVICE FOR THE CONTINUOUS CASTING OF METALS, IN PARTICULAR STEEL MATERIAL, TO FORM ELONGATED PRODUCTS IN A MULTIPLE CASTING LINE

(75) Inventors: Thomas Fest, Dulsburg (DE); Herbert Brotzki, Dulsburg (DE); Martin Becker, Düsseldorf (DE); Adolf Gustav Zajber, Langenfeld (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/528,380

(22) PCT Filed: Sep. 2, 2003

(86) PCT No.: PCT/EP03/09710

§ 371 (c)(1),
(2), (4) Date: Mar. 16, 2005

(87) PCT Pub. No.: WO2004/028723

PCT Pub. Date: Apr. 8, 2004

(65) Prior Publication Data

US 2006/0048915 A1 Mar. 9, 2006

(30) Foreign Application Priority Data

Sep. 21, 2002 (DE) ..... 102 44 596

(51) Int. Cl.
*B22D 11/053* (2006.01)

(52) U.S. Cl. ..... 164/416; 164/420

(58) Field of Classification Search ..... 164/416, 164/420, 478
See application file for complete search history.

(56) References Cited

U.S. PATENT DOCUMENTS

| | | | | |
|---|---|---|---|---|
| 4,195,684 | A | 4/1980 | Tsuchida | |
| 5,771,957 | A | 6/1998 | Von Wyl et al. | |
| 6,138,743 | A * | 10/2000 | Zajber et al. | 164/416 |
| 6,167,941 | B1 * | 1/2001 | Schallenberg | 164/416 |
| 6,889,748 | B1 * | 5/2005 | Fischer et al. | 164/416 |

FOREIGN PATENT DOCUMENTS

| | | |
|---|---|---|
| EP | 0 468 607 | 1/1992 |

* cited by examiner

*Primary Examiner*—Kuang Y. Lin
(74) *Attorney, Agent, or Firm*—Andrew Wilford

(57) ABSTRACT

A device for the continuous casting of metals, especially steel material, to elongated products in a multistrand casting apparatus with a plurality of continuous casting molds which are oscillatingly driven in an oscillating frame (2) by means of leaf springs (4) whereby the leaf springs (4) extend transversely to the casting direction (1) and serve for guide and weight compensation. The smallest possible strand spacing "A" is provided for that on a longitudinal foundation frame (5) to housings (6*a*) in the form of compact flat cassettes (6) are secured one behind the other in the strand travel direction. In the housings upper and lower leaf spring pairs (4*a*; 4*b*) run transversely to the cast strands (3) and the oscillating strands (11) engage the leaf spring pairs (4*a*; 4*b*), whereby a front oscillating drive (11*a*) works synchronously with the rear oscillating drive (11*b*).

8 Claims, 6 Drawing Sheets

Figure 1:
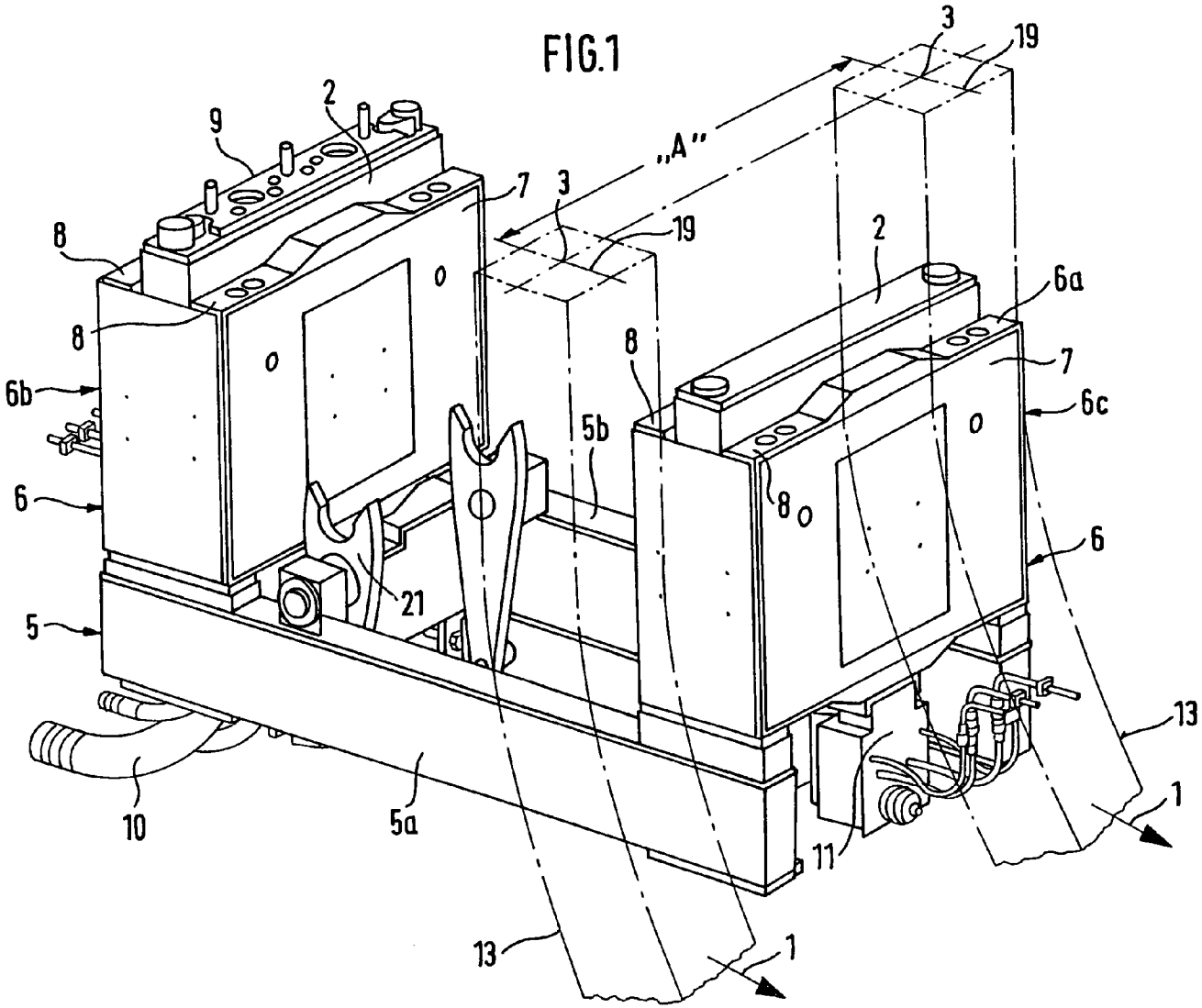

DEVICE FOR THE CONTINUOUS CASTING OF METALS, IN PARTICULAR STEEL MATERIAL, TO FORM ELONGATED PRODUCTS IN A MULTIPLE CASTING LINE

CROSS REFERENCE TO RELATED APPLICATIONS

This application is the US national phase of PCT application PCT/EP2003/009710 filed 2 Sep. 2003 with a claim to the priority of German patent application 10244596.6 itself filed 21 Sep. 2002.

The invention relates to an apparatus for the continuous casting of metals, especially steel materials, to elongated products in a multistrand casting plant, with several strand casting molds, each of which is mounted to oscillate separately in an oscillating frame which is driven to oscillate in the casting direction by plate or leaf spring pairs on both sides of the cast strand and which extend transversly to the casting direction for guiding and weight compensation on a base frame.

From EP 0 468 607 B2, a liquid-cooled mold for the continuous casting of metals is known, with which billet-shaped, bloom-shaped and round strands can be cast by means of a tubular mold. For that purpose the mass of the mold depends upon the particular strand format or shape and is determined based thereon so that for a slab format or shape the mold can weigh about 30 metric tons while the weight of a mold for round or rectangular cross section strands can be about 1.3 to 2.5 tons. With the reduction of mold weight, higher oscillation numbers (oscillations per unit time) can be reached with the smallest utilization of applied force.

The present invention is concerned however with so-called multiple casting units, i.e. multiple strand casting plants, in which a plurality of cast strands are produced simultaneously alongside one another. With such multi-strand casting plants, it is desirable to have the smallest possible strand spacing or interstrand spacing from cast strand to cast strand as measured form mold center to mold center. For newly constructed continuous casting plant, such multistrand casting systems reduce the cost of producing the product and with conversation of single strand plants to multistrand plants, the capital cost for such production can be reduced as well. At the same time in such conversions, stirring or agitation coils which can have an inductive effect on the liquid core of the cast strand, can be incorporated as well.

It is the object of the invention to provide in continuous casting plants, also with so-called resonance molds, as described at the outset and whose significant feature is a leaf spring casing or unit or stack, the smallest possible strand spacing between the cast strands.

This object is achieved in accordance with the invention in that in an apparatus as described at the outset, on an elongated base frame and in the strand travel direction the compact flat-cassette housings are secured in which the upper and lower leaf spring pairs run transversely to the cast strands and upon which the oscillating drive act on the leaf spring pairs whereby a front oscillating drive operates synchronously with the rear oscillating drive. The advantage in such a transverse arrangement with a crossing of the cast strand by comparison with prior longitudinal arrangements is a significant place and space saving so that the distance from cast strand to cast strand can be held as small as possible. The arrangement of the flat cassettes one behind the other with the respective oscillating drives in the casting direction and a crossing transverse arrangement of the plate or leaf spring transverse to the casting axes or the casting strands enables the formation of a sufficiently large space for the continuous casting mold to be built in between the two flat cassettes. At the same time sufficient free space is obtained for the incorporation of a so-called zero support roll segment. Close to the entire strand spacing "A" can thereby be used.

According to further features it is proposed that the front oscillation drive be adjusted with respect to the rear oscillation drive with different strokes for an arcuate pattern of the casting strands. In that case, the rear oscillation drive can be set to a higher stroke relative to the front oscillation drive.

Another advantage resides in that the oscillation drives may be comprised of hydraulic drive units. The oscillation drives can be arranged in protected space below the base or foundation frame.

Further features include that the flat cassettes are comprised of two rectangular frames disposed one behind the other in the strand travel direction and each of which has two plate spring or leaf spring pairs of plate or leaf springs spaced apart in their heights, and that between the rectangular frames, a mold-seating frame is surprisingly arranged. In this manner the two rectangular frames can simultaneously form a guide for the mold receiving frame.

The special protection for the drives can be achieved by locating the oscillating drive units each in the median plane of the continuous strand below the two rectangular frames and between longitudinal beams of the base or foundation frame. Apart from a protected location, this arrangement provides advantages in attachment location.

Other features include that the foundation or base frame can have suspension elements between the longitudinal beam and upon which the suspenders for a support or guide roll segment can be mounted. In this manner the introduction of a support or guide roll segment prior to mounting of the continuous casting mold can be facilitated.

In a further feature it is provided that the suspension elements comprise a double-arm lever rotationally journaled on the longitudinal beams and a suspension trough formed at one lever end and an adjustment device on another lever end.

The configuration of the apparatus can be further developed in that a water clamping plate for supplying the continuous casting mold with cooling medium can be disposed on the rear flat cassette and in that the cooling medium feed and the cooling medium discharge run away from the casting strand rearwardly.

In the drawing, embodiments of the invention have been illustrated which are described in greater detail hereinafter.

THE DRAWING SHOWS

Figure 2:
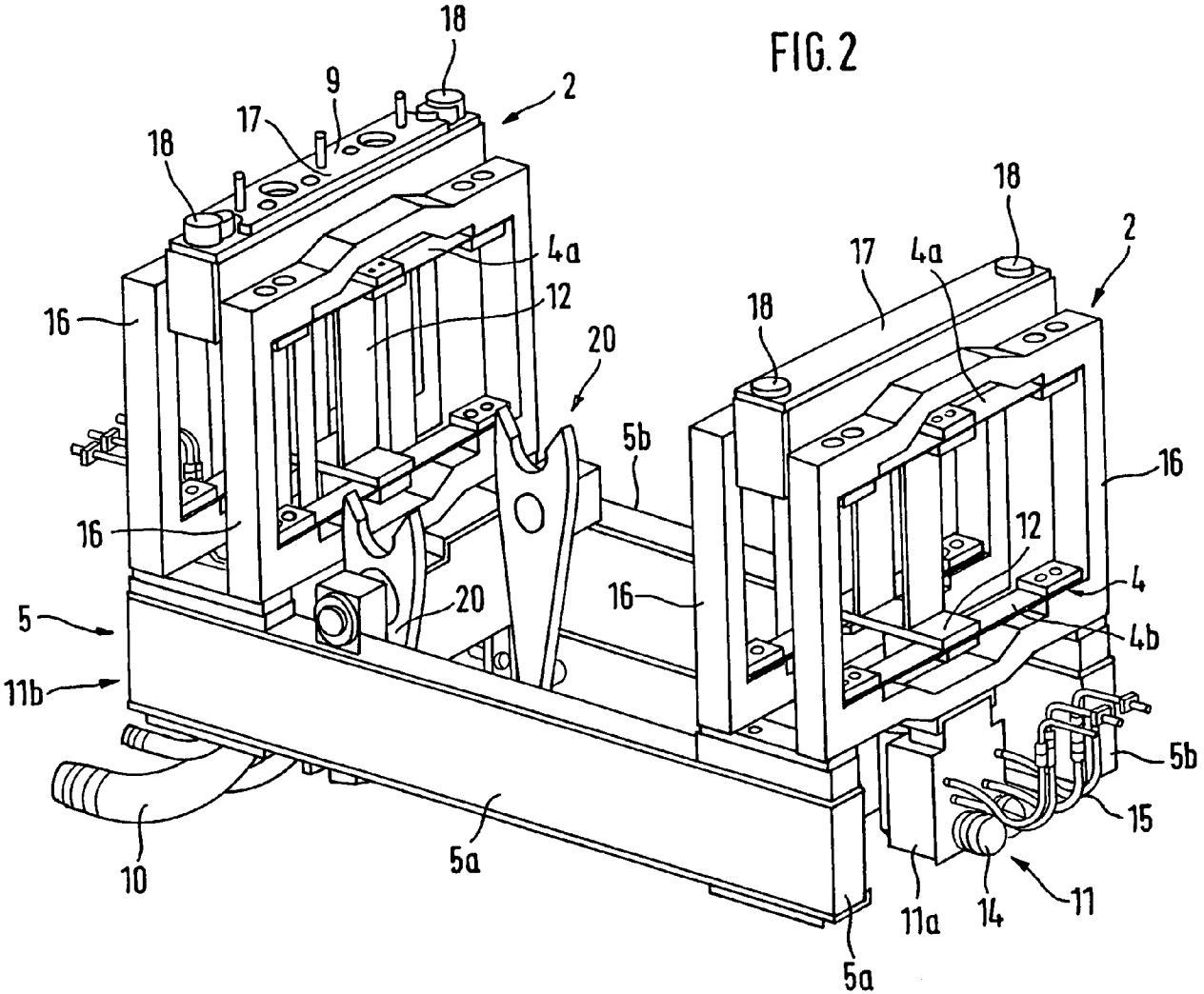
Figure 3:
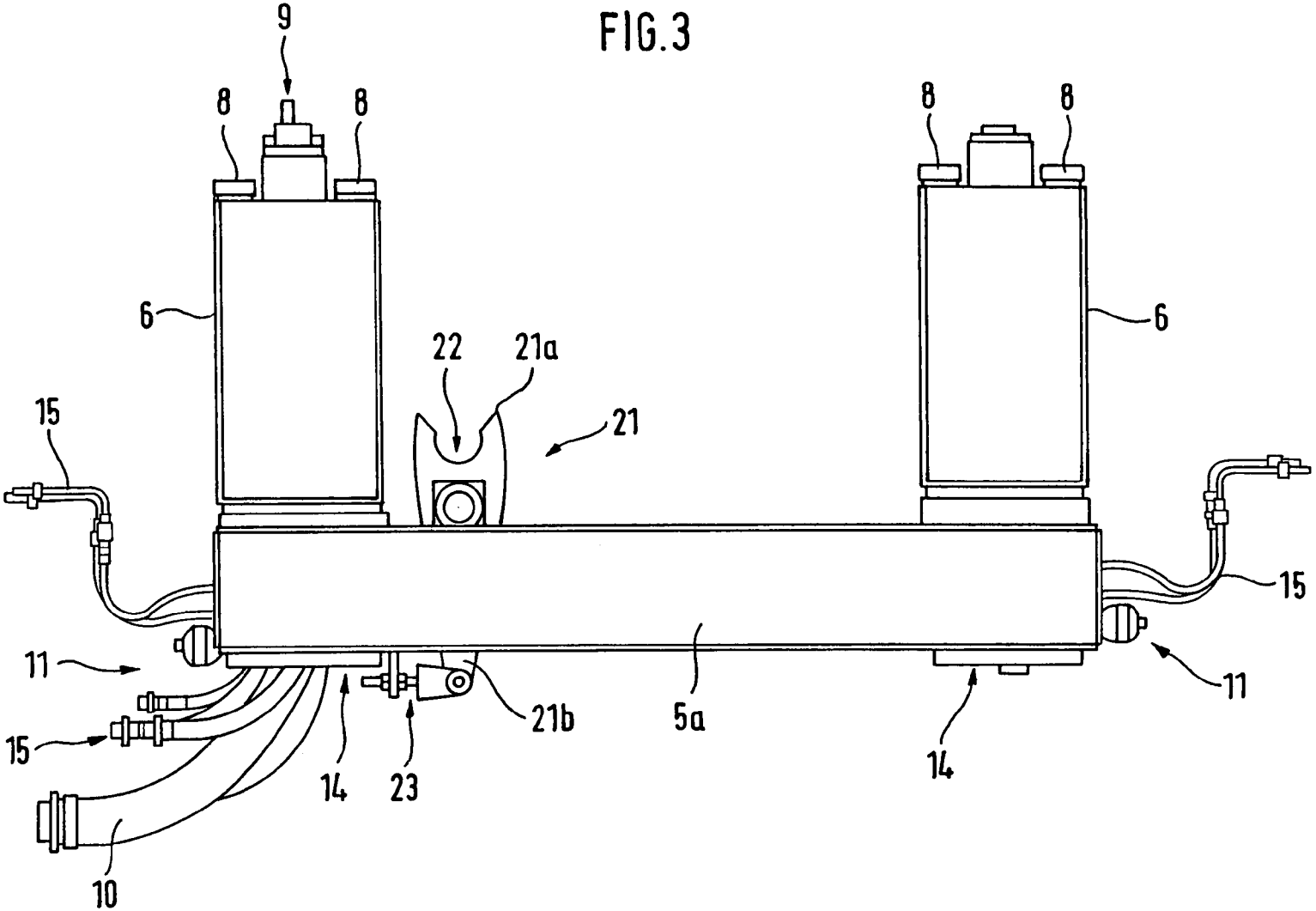
Figure 4:
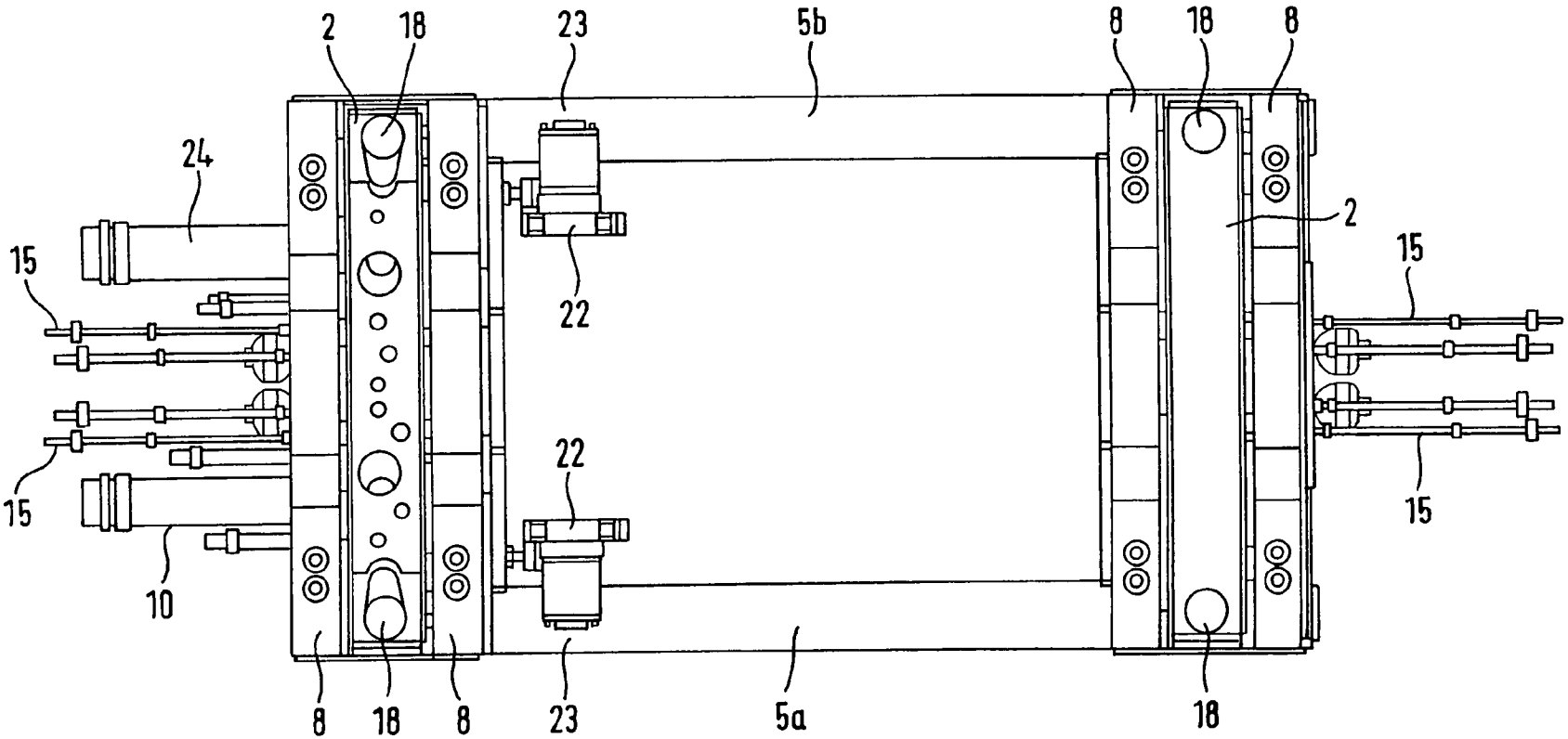
Figure 5:
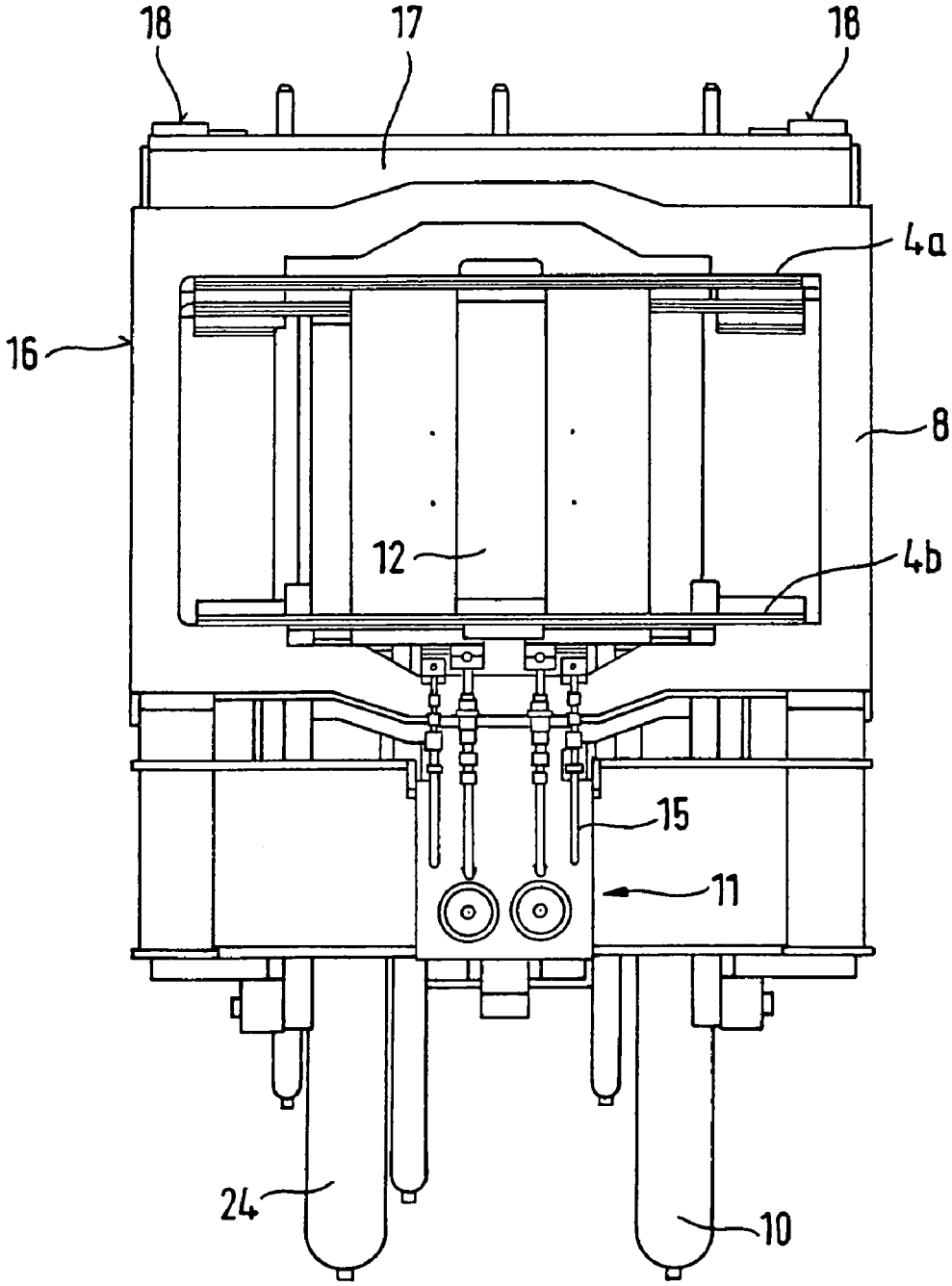
Figure 6:
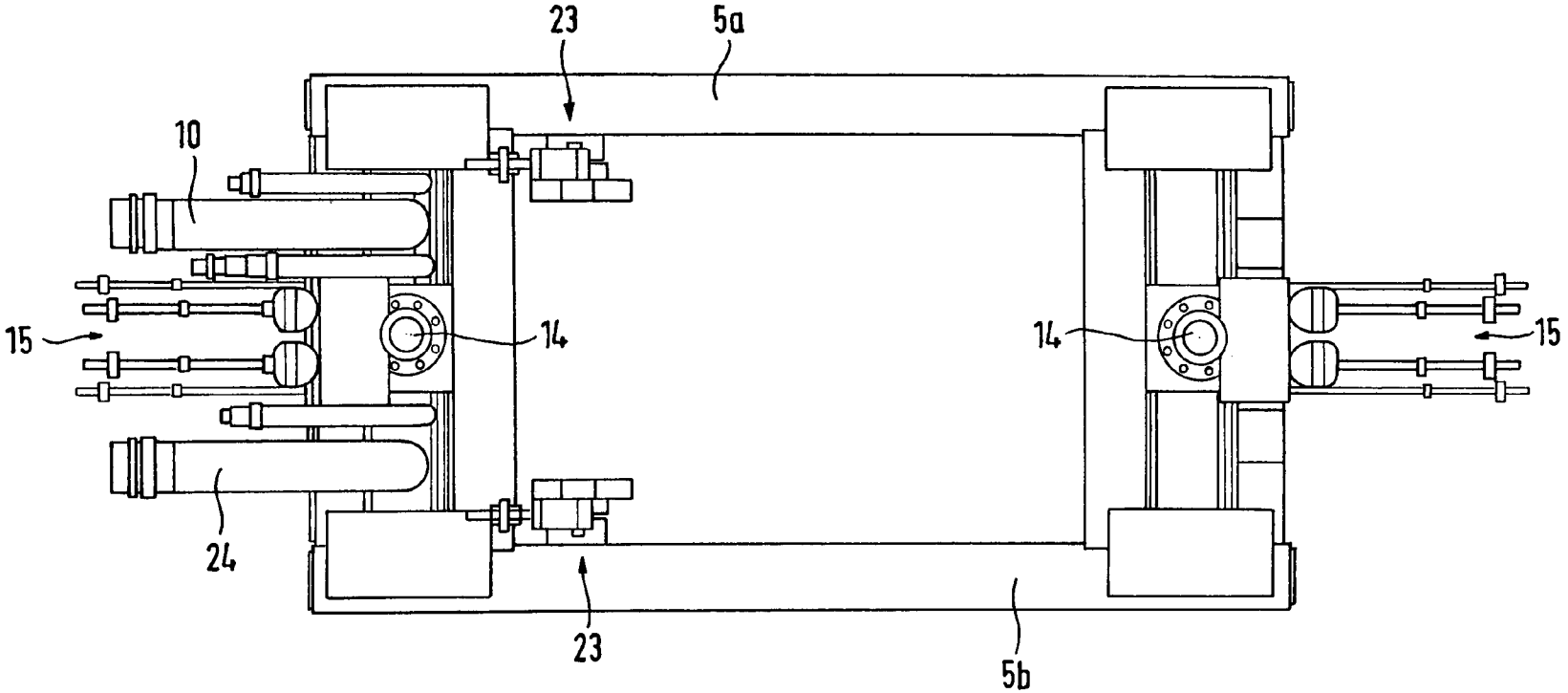

FIG. 1 a perspective view of the apparatus in an overall illustration,

FIG. 2 a perspective view according to FIG. 1 without the protective covering, FIG. 3 a side view in a vertical plane without the first casting strand, FIG. 4 a plan view of the apparatus, FIG. 5 a front elevational view of the apparatus with the protective covering removed, and FIG. 6 a bottom plan view of the apparatus.

In a multistrand casting plant or operation (FIG. 1) with a multiplicity of cast strands 3 running parallel to one another in the casting direction 1, for each of the cast strands, there is a continuous casting mold (not shown) and a support roll frame in a segmental configuration (not shown), configured to produce longitudinal products like for example billets, blooms (pre-ingots), round cross sections or profile cross sections alongside one another. Each of the continuous casting molds is mounted separately in an oscillating frame 2 driven to oscillate in the casting direction 1. Each oscillating frame 2 is connected by means of plate or leaf springs 4 (FIG. 2) with the respective continuous casting mold or to the mold table. The oscillating movement is effected in the casting direction 1 as a sinusoidal movement. Usually a greater velocity of the continuous casting mold is provided during the rearward movement of the mold than is the speed of the cast strand 3. The oscillating frequency and the magnitude of oscillation are matched to one another. The leaf spring or plate spring pairs 4*a* and 4*b* extend transversly to the casting direction 1 and cross the cast strand 3 and serve to guide and for weight compensation of the continuous casting mold on a base frame 5.

So that a plurality of cast strands 3 or casting lines is can be provided to adjoin one another as closely as possible, that is to achieve a spacing A which is as small as possible (FIG. 1), each foundation frame 5 is formed as an elongated rectangle in the continuous casting direction. The base frame 5 is respectively formed from longitudinal beams 5*a* and 5*b*.

At the rear end and at the front end of the base frame 5 there are respective compact flat cassettes 6 which extend in their respective longitudinal directions transversely to the casting lines 3 and bridge the space between the two longitudinal beams 5*a* and 5*b*. Each flat cassette 6 is comprised of a closed housing 6*a*, whereby a rear flat cassette 6*b* and a front flat cassette 6*c* define a space between them for receiving a continuous casting mold.

Each flat cassette 6 is formed by the housing 6*a* together with protective covers 7 on both sides. Within the housing 6*a* are base frames 8, two of which are provided parallel to one another and spaced apart, together with the leaf springs or plate springs which will be described in greater detail hereinafter and are formed as upper and lower plate springs or leaf spring pairs 4*a* and 4*b* transverse to the longitudinal direction and which form articulations. Between the two base frames 8 of each cassette 6, a water clamping plate 9 is provided for the cooling of the continuous casting mold and is connected from below with a cooling medium supply 10.

The configuration of each flat cassette 6 with its housing 6*a* open, that is with the cover protectors 7 removed, has been shown. In each flat cassette 6, that is in each case two pairs of upper plate spring pairs 4*a* and lower plate spring pairs 4*b* are associated with an oscillating drive 11 acting on or fastened to a bridge 12 connecting the upper and lower pairs of springs. The front oscillating drive 11*a* and the rear oscillating drive 11*b* which together form the oscillating drive 11 are synchronized to effect an arcuate travel 13 of the strands with unequal strokes but the same frequency. The oscillating drives 11*a* and 11*b* are for example configured as hydraulic oscillating drive units 14 which are fed by hydraulic lines 15.

As can also be seen from FIG. 2, each flat cassette 6 which is comprised of the two parallel rectangular frames 16 lying one behind the other in the casting direction 1 (FIG. 1) has the respective plate or leaf spring pairs 4*a*, 4*b* of each frame 16 spaced apart at different heights, with the frames 16 of each cassette receiving between them respective mold support frames 17 to oscillate with the respective bridge 12 as actuated by the respective drive 11*a*, 11*b*. Each of the mold support frames 17 has two mold support surfaces 18 at their ends.

The oscillation drive units 14 are located in the median plane 19 (FIG. 1) of the casting lines 3 below two rectangular frames 16 and between the longitudinal pairs 5*a*, 5*b* of the foundation frame.

According to FIGS. 1 and 2, between the longitudinal beams 5*a*, 5*b*, suspension elements 20 are mounted upon which a support roll segment (not further illustrated) can be suspended and which receives the cast stands 3 and their travel below the continuous casting mold. The suspension elements 20 are comprised of a double-arm lever 21 pivotally mounted on the longitudinal beams 5*a*, 5*b* and which has at one lever end 21*a* a suspension trough 22 (FIG. 3) and on the other lever end 21*b* an articulation to an adjusting device 23 with which the exact position of the suspended support roll segment can be set.

According to FIG. 3 and in combination with FIG. 4 there is shown the water clamping plate 9 for the rear flat cassette 6*b* which supplies the continuous casting mold with the cooling medium. In addition, apparent from these illustrations is the fact that the cooling medium feed 10 and the cooling medium discharge 24 run rearwardly from the rear side of the device and therefore the side turned away from the hot cast strands 3.

In the plan view of FIG. 4, the cooling medium supply 10 and the cooling medium discharge 24 on the two sides, and in addition, the hydraulic lines 15 for the oscillating drive 112 have been shown. Each of the compact flat cassettes 6 contains two base frames 5 and between these base frames the respective oscillating frame 2 is disposed. In addition, the four mold support surfaces 18 are visible. It is also possible to see in this Figure the adjusting devices 23 for the double-arm levers 21 with their suspension troughs 22.

In the front view of FIG. 5, with the protective cover 7 removed, a base frame 8 can be seen in detail with its upper leaf spring or plate spring pair 4*a* and its lower leaf spring or plate spring pair 4*b* is connected to the connection bridge 12. In addition, the view is directed perpendicularly to the oscillating drive 11 whose hydraulic lines 15 can be seen. The rectangular frame configuration 16 extends slightly beyond the mold receiving frame 17 with its mold support surfaces 18. The cooling medium feed 10 and the cooling medium discharge 24 are arranged at the rear side of the device.

In the plan view from below, FIG. 6, the hydraulic oscillating drive units 24 are visible from below. In addition, the eye can form on the hydraulic lines 15 which lie on both sides of the foundation frame 5 with the longitudinal beams 5*a* and 5*b*. In addition, the adjusting devices 23 (with the suspension troughs 22 not visible here) for a support roll segment are visible from below.

REFERENCE CHARACTER LIST

1 Casting direction, strand travel direction
2 Oscillating frame
3 Cast lines, casting strand
4 Leaf or plate spring
4*a* Upper leaf or plate spring pair
4*b* Lower leaf or plate spring pair
5 Foundation frame
5*a* Longitudinal beam
5*b* Longitudinal beam
6 Compact flat cassette
6*a* Housing
6*b* Rear flat cassette
6*c* Front flat cassette
7 Protective cover

8 Base frame
9 Water clamping plate
10 Cooling medium feed
11 Oscillating drive
11*a* Front oscillating drive
11*b* Rear oscillating drive
12 Connecting bridge
13 Arcuate path of the cast strand
14 Hydraulic oscillating drive unit
15 Hydraulic lines
16 Rectangular frame
17 Mold support frame
18 Mold support surfaces
19 Median planes of the cast strands
20 Suspension element
21 Double-arm lever
21*a* Lever end
21*b* Lever end
22 Suspension trough
23 Adjusting device
24 Cooling medium discharge

What is claimed is:

1. A device for the continuous casting of metals, especially steel materials, to elongated products in a multistrand casting apparatus with a plurality of continuous casting molds which are separately mounted in respective oscillating frames (2) oscillatingly driven in a casting direction (1), the casting frames being mounted on both sides of the casting strands (3) by leaf spring pairs (4) which extend transversely to the casting direction for guiding and weight compensation on a foundation frame, characterized in that, two housings (6*a*) configured as compact flat cassettes (6) are arranged one behind the other in the continuous casting direction (1) on an elongated foundation frame (5), in which housing upper and lower leaf spring pairs (4*a*; 4*b*) extend transversely to the cast strands (3) and that oscillating drives (11) engage the leaf spring pairs (4*a*; 4*b*), whereby a front oscillating drive (11*a*) operates synchronously with the rear oscillating drive (11*b*).

2. The device according to claim 1, characterized in that, the front oscillating drive (11*a*) is set with respect to the rear oscillating drive (11*b*) for an arcuate path (13) of the cast strand (3) to operate with different strokes.

3. The device according to claim 1, characterized in that, the oscillating drives (11*a*; 11*b*) are comprised of hydraulic drive units.

4. The device according to claim 1, characterized in that, the flat cassettes (6) are comprised of two rectangular frames (16) each of which has two leaf spring pairs (4*a*; 4*b*) forming a leaf spring spaced apart in height, the frames being spaced apart in the strand travel direction (1) and in that between the rectangular frames a mold support frame (17) is arranged.

5. The device according to claim 1, characterized in that, oscillating drive units (14) each are arranged in the median plane (19) of the continuous casting strand (3) beneath the two rectangular frames (16) and between longitudinal beams (5*a*; 5*b*) of the foundation frame (5).

6. The device according to claim 1, characterized in that, in the foundation frame (5) between longitudinal beams (5*a*; 5*b*) suspension elements (20) are pivotally mounted for suspending a support roll segment.

7. The device according to claim 6, characterized in that, the suspending elements (20) are comprised of a respective double arm lever (20) pivotally mounted on the longitudinal beam (5*a*; 5*b*), with a suspension trough (22) on one lever end (21*a*) and an adjusting device (23) connected to another lever end (21*b*).

8. The device according to claim 1, characterized in that, a water clamping plate (9) for supplying the continuous casting mold with a cooling medium is arranged on the rear flat cassette (6*b*) and the cooling medium feed (10) and the cooling medium discharge (24) run rearwardly away from the cast strand (3).

* * * * *